United States Patent [19]

Dretzka et al.

[11] 4,262,622

[45] Apr. 21, 1981

[54] MARINE PROPULSION DEVICE INCLUDING IGNITION INTERRUPTION MEANS TO ASSIST TRANSMISSION SHIFTING

[75] Inventors: Robert G. Dretzka, South Milwaukee; James L. Holt, Bristol, both of Wis.; Guy D. Payne, Lake Villa, Ill.

[73] Assignee: Outboard Marine Corporation, Waukegan, Ill.

[21] Appl. No.: 25,343

[22] Filed: Mar. 30, 1979

[51] Int. Cl.[3] ..... B63H 5/06

[52] U.S. Cl. ..... 440/1; 74/851; 74/852; 440/84; 440/86

[58] Field of Search ..... 115/34 R, 17, 18 R, 115/41; 123/148 S, 198 DC, 102, 118; 74/860, 855, 851, 852, 856, 861, 843, 844

[56] References Cited

U.S. PATENT DOCUMENTS

| | | | |
|---|---|---|---|
| 2,297,676 | 10/1942 | Elkin | 74/852 |
| 2,703,989 | 3/1955 | Schroeder | 74/843 |
| 3,792,630 | 2/1974 | Hause | 74/860 |

*Primary Examiner*—Sherman D. Basinger

*Attorney, Agent, or Firm*—Michael, Best & Friedrich

[57] ABSTRACT

Disclosed herein is a marine propulsion device and apparatus and methods for assisting transmission shifting thereof. The marine propulsion device includes an internal combustion engine and a reversing transmission having a pair of bevel gears and a clutch dog movable between a neutral position out of engagement with the bevel gears and forward and reverse drive positions in full engagement with one of the bevel gears. The marine propulsion device also includes a shift assistance arrangement included in a shift mechanism for axially moving the clutch dog between the neutral and drive positions, and which includes a load sensing lost motion shift lever arrangement having a first switch which is actuated when the resistance to axially moving the clutch dog into a drive position exceeds an upper limit. The shift assistance arrangement also includes an ignition interruption circuit responsive to actuation of the first switch for selectively interrupting the ignition of the internal combustion engine to reduce the engine torque transmitted to the bevel gears to effect relative angular displacement of the clutch dog and the bevel gears to thereby assist the shift mechanism in moving the clutch dog into and out of a drive position. The ignition interruption circuit includes a control circuit having a first timer for providing a plurality of successive timed cycles, each cycle including an ignition-kill interval and an ignition-on interval, and also having a second timer for establishing an overall cycle during which the first timer is operative, subject to the first switch.

41 Claims, 10 Drawing Figures

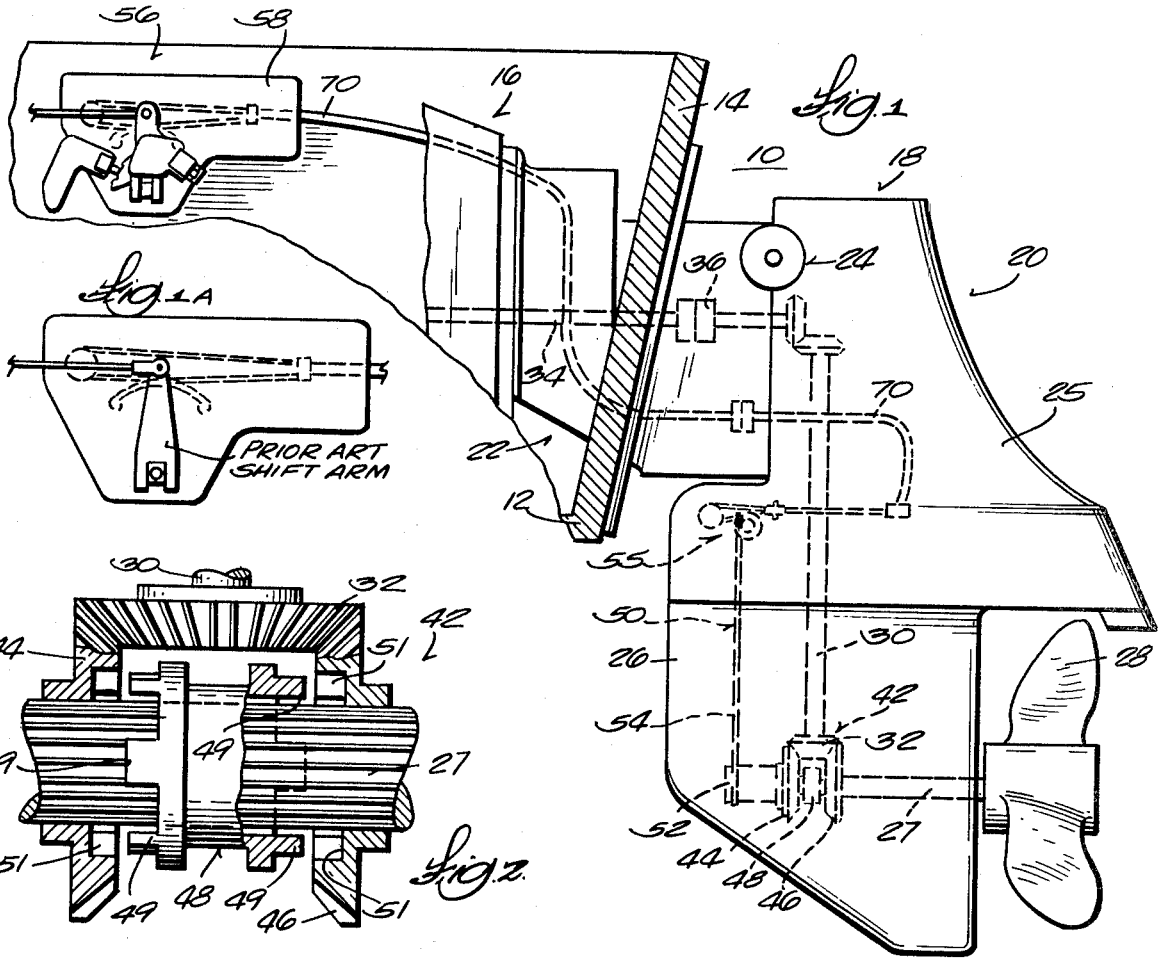
56
58
70
16
14
Fig. 1
10
18
36
24
20
34
70
25
22
12
55
50
26
30
28
54
42
32
52
27
44
48
46
Fig. 1A
PRIOR ART SHIFT ARM
30
32
42
44
51
49
27
51
49
48
49
46
51
Fig. 2
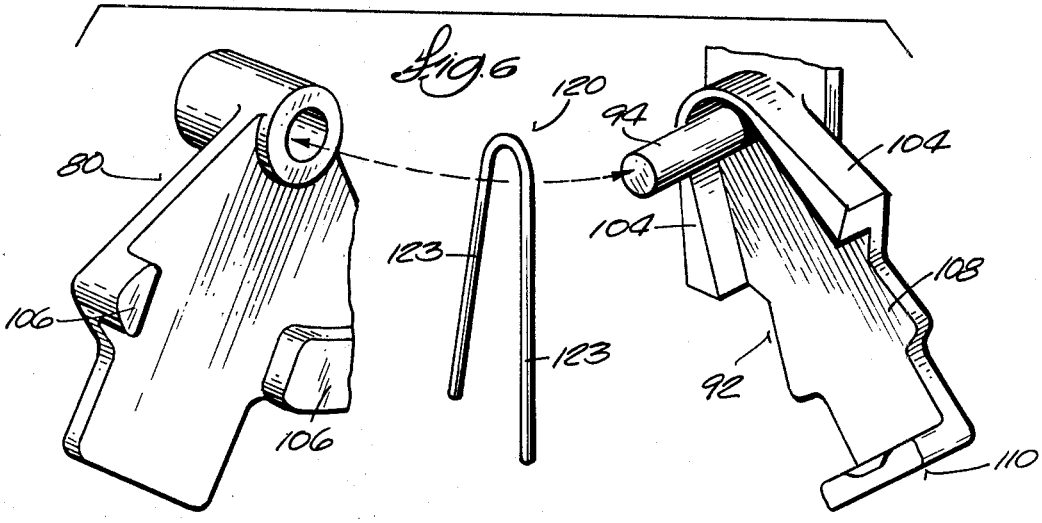
Fig. 6
120
94
104
80
104
123
108
106
123
92
106
110
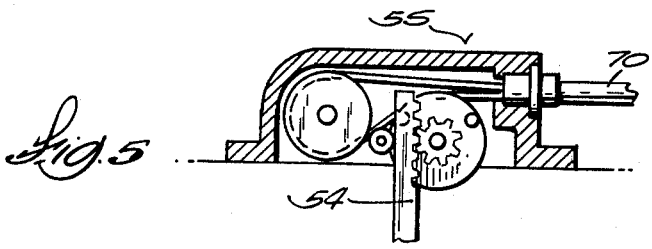
55
70
Fig. 5
54

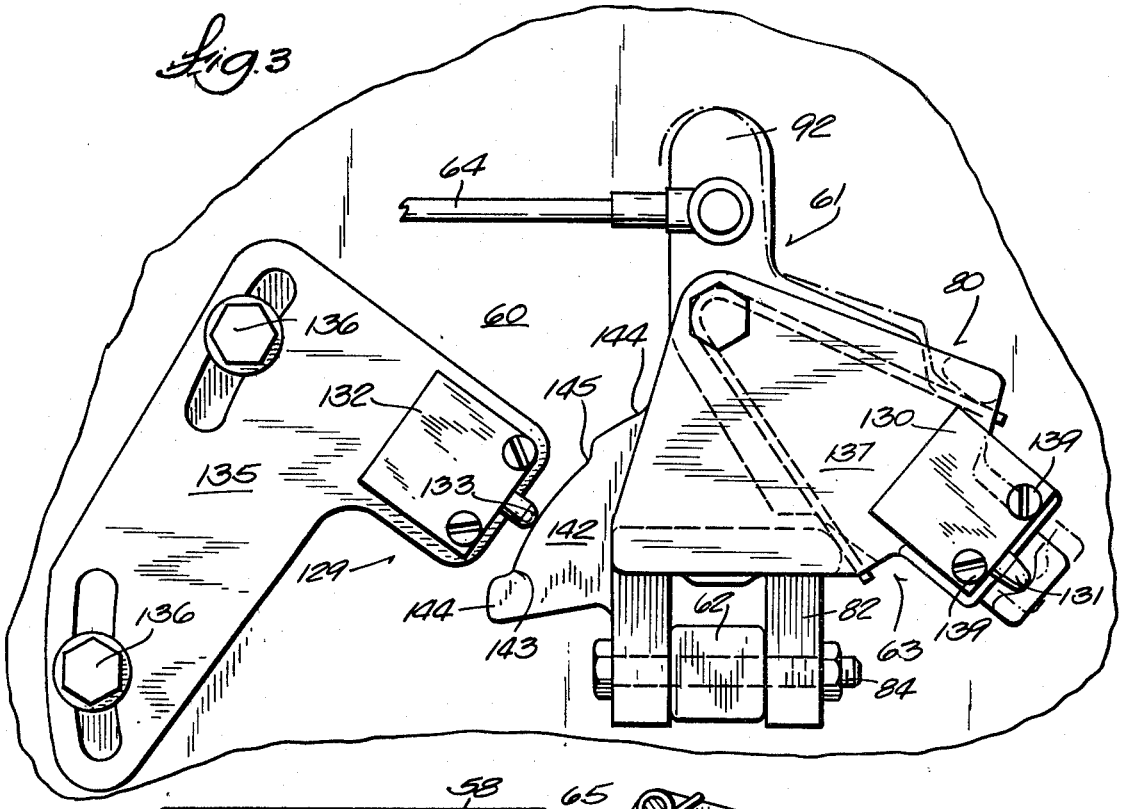
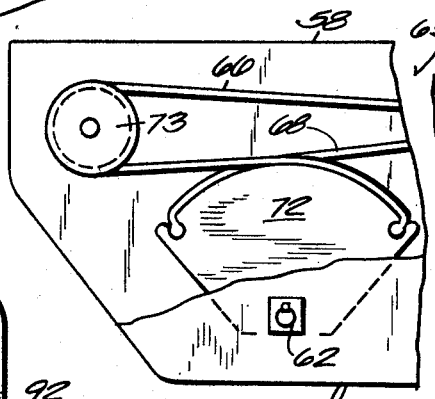
Fig. 4
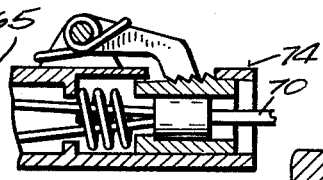
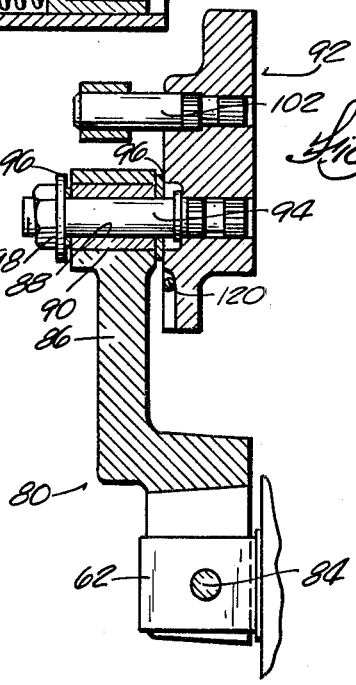
Fig. 8
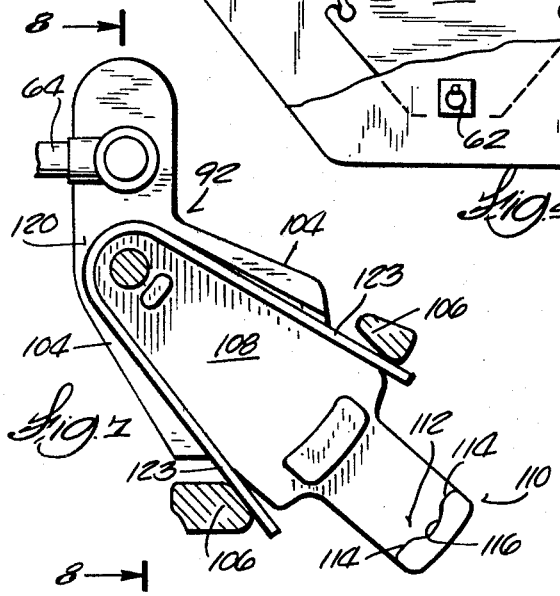
Fig. 7

MARINE PROPULSION DEVICE INCLUDING IGNITION INTERRUPTION MEANS TO ASSIST TRANSMISSION SHIFTING

BACKGROUND OF THE INVENTION

The invention relates generally to marine propulsion devices, and more particularly, to marine propulsion devices such as stern drive units and outboard motors including a reversing transmission and a shifting mechanism therefor. Still more particularly, the invention relates to marine propulsion devices including means to assist transmission shifting.

Attention is directed to the following United States Patents which relate to marine propulsion devices including reversing transmissions and shifting mechanisms therefore.

| | | |
|---|---|---|
| Kroll | 3,842,788 | Issued October 22, 1974 |
| Shimanckas | 3,183,880 | Issued May 18, 1965 |
| Kroll | 3,977,356 | Issued August 31, 1976 |
| Yourich | 3,386,546 | Issued June 4, 1968 |
| Barnes | 3,919,510 | Issued November 11, 1975 |
| Schmiedel | 3,858,101 | Issued December 31, 1974 |

Attention is also directed to pending U.S. patent application Ser. No. 890,499, filed Mar. 27, 1978 assigned to the same assignee as this application.

SUMMARY OF THE INVENTION

The invention provides apparatus for assisting transmission shifting in a marine propulsion device including an internal combustion engine and a transmission having a bevel gear and a clutch dog movable between a neutral position out of engagement with the bevel gear and a drive position in full engagement with the bevel gear, which apparatus comprises a first member movable in response to clutch dog movement, a second member movable in response to actuation by an operator and connected to the first member for movement in common therewith and for movement relative to the first member, and means for interrupting engine ignition in response to relative movement between the first and second members.

In one embodiment, the engine ignition interrupting means includes means operative in response to relative movement between the first and second members for interrupting engine ignition, and means operative in response to movement of the first member corresponding to movement of the clutch dog into full engagement with the gear for discontinuing engine ignition interruption notwithstanding the position of the first and second members relative to each other.

The invention also provides a marine propulsion device including an internal combustion engine, a propulsion unit, a propeller shaft rotatably mounted in the propulsion unit and carrying a propeller, a drive shaft rotatably mounted in the propulsion unit and adapted to be driven by the internal combustion engine, which drive shaft includes a drive gear, a transmission including a bevel gear rotatably mounted on the propeller shaft and in meshing engagement with the drive gear and including clutch dog means mounted to the propeller shaft for reciprocal axial movement between a neutral position wherein the clutch dog means is out of engagement with the bevel gear, and a drive position wherein the clutch dog means is in full engagement with the bevel gear to effect coincident rotation of the bevel gear and the propeller shaft, and shift means for axially moving the clutch dog means between the neutral and drive positions, which shift means includes shift assistance means including a first member movable in response to clutch dog movement, a second member movable in response to actuation by an operator and connected to the first member for movement in common therewith and for movement relative to the first member, and means for interrupting engine ignition in response to relative movement between the first and second members.

In one embodiment of the invention, the apparatus further includes means yieldably biasing the first and second members for movement in common with each other.

In one embodiment of the invention, the apparatus further includes means for preventing relative movement between the first and second members in the absence of a force which resists full engagement of the clutch dog means with the gear and which exceeds, by more than a pre-selected amount, a force applied by the operator.

In one embodiment of the invention, the ignition interruption means includes control means operable for interrupting the engine ignition in accordance with a timed cycle including an ignition-kill interval wherein the engine ignition is interrupted, and an ignition-on interval wherein the engine ignition is enabled.

Also in accordance with an embodiment of the invention, the ignition interruption means includes first switch means operable when actuated for rendering the ignition interruption means operable to selectively interrupt the ignition of the internal combustion engine, and one of the first and second members includes first cam means for actuating the first switch means in response to relative displacement of the first and second members from the normal position.

Also in accordance with an embodiment of the invention, the ignition interruption means further includes second switch means operable when actuated for overriding the first switch means and terminating the selective interruption of the ignition, and the first member includes second cam means for actuating the second switch means when the first member is displaced to a position generally corresponding to the clutch dog means having completed movement to the drive position.

Also in accordance with an embodiment of the invention, the bias means of the ignition interruption means comprises a generally U-shaped spring having a pair of outwardly extending arms, and the first and second members include complimentary flange means for retaining the U-shaped spring in a generally fixed position relative to the first and second members when the shift resistance is less than the upper limit, and for displacing one of the spring arms relative to the other spring arm when the shift resistance exceeds the upper limit and the second member pivots relative to the first member.

Also in accordance with an embodiment of the invention, the ignition interruption means includes control means operable for interrupting the engine ignition in accordance with one or more timed cycles, each timed cycle including an ignition-kill interval wherein the engine ignition is interrupted, and an ignition-on interval wherein the engine ignition is enabled. The control means preferably includes first timer means for providing a plurality of the timed cycles in succession.

Also in accordance with an embodiment of the invention, the first timer means is operative for successively increasing the duration of the ignition-kill intervals included in the successive timed cycles.

Also in accordance with an embodiment of the invention, the control means includes second timer means coupled to the first timer means for establishing an overall cycle during which the first timer means is rendered operative for providing the successive timed cycles.

Also in accordance with an embodiment of the invention, the first timing means is operative for providing successive timed cycles wherein the initial ignition-kill interval of the overall cycle has a predetermined minimum duration, and wherein the control means further comprises speed sensing means coupled to the first timer means and operative in response to engine speed increasing above a predetermined lower speed for increasing the duration of the initial ignition-kill interval above the predetermined minimum duration. The speed sensing means is preferably operative for increasing the duration of the initial ignition-kill interval up to a predetermined maximum duration.

Also in accordance with an embodiment of the invention, the invention provides an ignition interruption circuit wherein the control means includes interface switch means operable, when actuated, for interrupting engine ignition, and NAND gate means interconnected to the first and second timer means and to the interface switch means for making the ignition interruption circuit generally insensitive to noise so as to prevent false interruption of the engine ignition.

The invention also provides a method for assisting transmission shifting in a marine propulsion device including an internal combustion engine and a transmission having a bevel gear and a clutch dog movable between a neutral position out of engagement with the bevel gear and a drive position in full engagement with the bevel gear, a first member movable in common with clutch dog movement, and a second member movable in response to actuation by an operator and connected to the first member for movement in common therewith and for movement relative to the first member, which method comprises the steps of interrupting engine ignition in response to relative movement between the first and second members.

In one embodiment in accordance with the invention, the method comprises the steps of interrupting engine ignition in response to relative movement between the first and second members, and discontinuing engine ignition interruption notwithstanding the position of the first and second members relative to each other in response to full engagement of the dog with the gear.

One of the principal features of the invention is the provision of providing shift assistance means for a reversing transmission in a marine propulsion device including an internal combustion engine, which shift assistance means selectively interrupts the ignition of the internal combustion engine to assist transmission shifting.

Another of the principal features of the invention is the provision of such a marine propulsion device wherein the shift assistance means comprises load sensing means for sensing shift resistance to moving a clutch dog into or out of engagement with one of the bevel gears of the transmission, and wherein the ignition interruption means is responsive to the load sensing means for selectively interrupting the ignition of the internal combustion engine when the shift resistance exceeds an upper limit.

Another of the principal features of the invention is the provision of such a marine propulsion device wherein the load sensing means comprises a lost motion shift lever arrangement having a switch which is actuated when there is resistance to transmission shifting, and wherein the ignition interruption means comprises an ignition interruption circuit rendered operative by actuation of the switch included in the load sensing means.

Another of the principal features of the invention is the provision of such a marine propulsion device wherein the shift lever arrangement further comprising position sensing means for generally sensing the axial position of the clutch dog during transmission shifting and having switch means responsive to the shift lever arrangement moving to a position corresponding to the transmission shifting being completed for overriding the first switch means to prevent continued interrupting of the engine ignition.

Another of the principal features of the invention is the provision of such a marine propulsion device wherein the ignition interruption circuit includes control means including a primary timer for interrupting the engine ignition in accordance with one or more timed cycles, each timed cycle including an ignition-kill interval wherein the engine ignition is interrupted, and an ignition-on interval wherein the engine ignition is enabled.

Another of the principal features of the invention is the provision of such a marine propulsion device wherein the primary timer is operative for increasing the duration of each successive ignition-kill interval, and wherein the control means includes an overall timer for establishing an overall cycle during which the primary timer is rendered operative, subject to completion of transmission shifting.

Another of the principal features of the invention is the provision of such a marine propulsion device wherein the control means includes speed sensor means operative to increase the duration of the initial ignition-kill interval of the overall cycle in response to increased engine speed.

Another of the principal features of the invention is the provision of such a marine propulsion device having control means including NAND gates and other components connected to the primary and overall timers so that the ignition interruption circuit is insensitive to the noise so as to prevent false interruption of the engine ignition.

Another of the principal features of the invention is the provision of a method for assisting transmission shifting in a marine propulsion device including an internal combustion engine and a transmission having a bevel gear and a clutch dog movable between a neutral position out of engagement with the bevel gear and a drive position in full engagement with the bevel gear, the method comprising the steps of sensing shifting of the transmission and selectively interrupting engine ignition during the transmission shifting prior to the clutch dog moving to the drive position.

Other features and advantages of the embodiments of the invention will become apparent to those skilled in the art upon reviewing the following detailed description, drawings and the depending claims.

BRIEF DESCRIPTION OF THE DRAWINGS

FIG. 1 is a fragmentary, side elevational view, partially in schematic, of a boat mounted stern drive unit incorporating various of the features of the invention.

FIG. 1*a* illustrates a prior art one-piece shift arm.

FIG. 2 is an enlarged partially sectional view of the transmission included in the stern drive unit shown in FIG. 1.

FIG. 3 is an enlarged, fragmentary view of the shift assistance means included in the shift means of the stern drive unit shown in FIG. 1.

FIG. 4 is a fragmentary view, partially in section and partially broken away, illustrating a portion of the pull-pull cable arrangement included in the shift means of the stern drive unit shown in FIG. 1.

FIG. 5 is an enlarged sectional view of the lower shift unit included in the shift means of the stern drive unit shown in FIG. 1.

FIG. 6 is an exploded fragmentary perspective view of the shift lever means included in the shift assistance means shown in FIG. 3.

FIG. 7 is a fragmentary plan view, partially broken away, of the shift lever means shown in FIG. 6.

FIG. 8 is a sectional view taken along lines 8—8 shown in FIG. 7.

Figure 9:
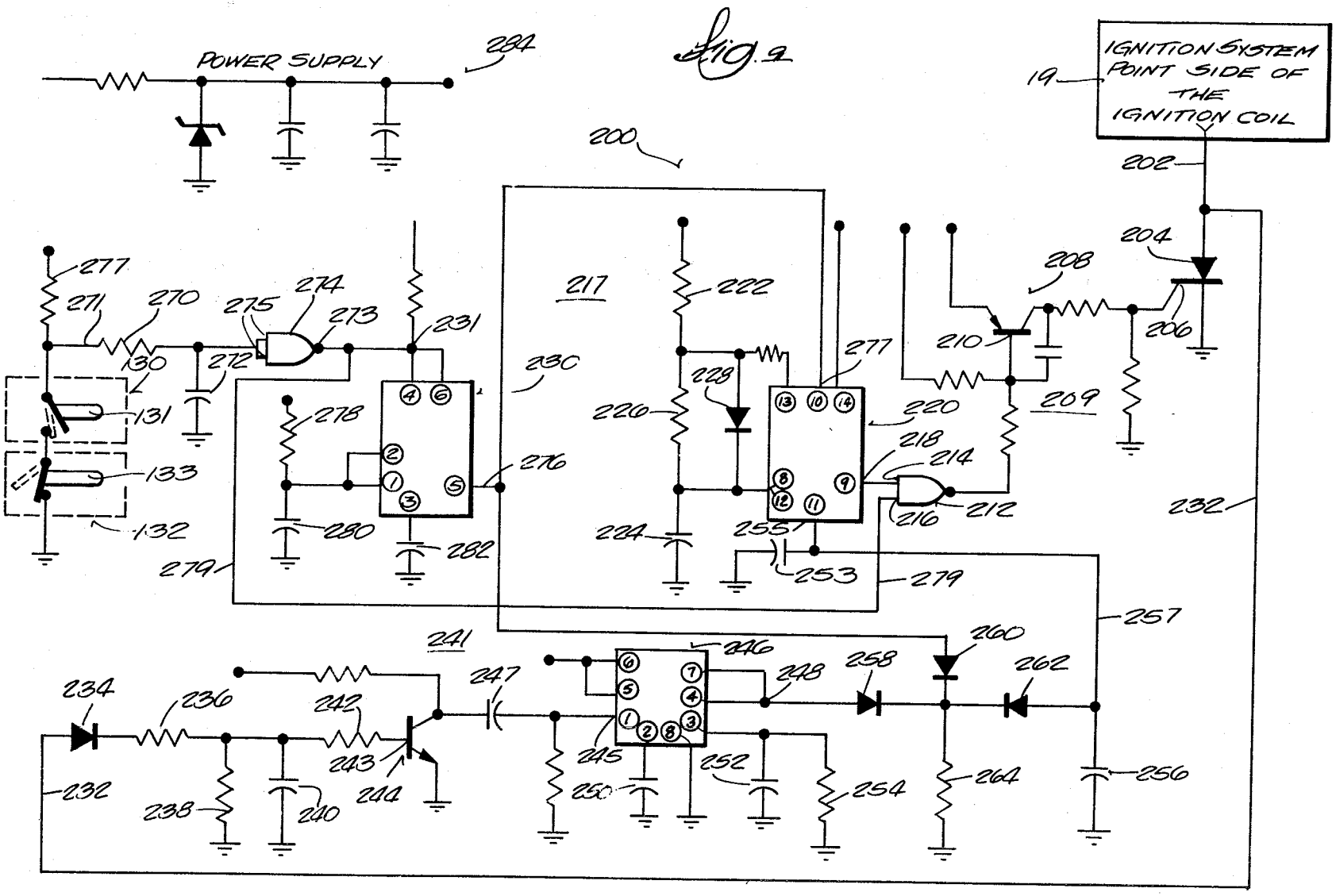
FIG. 9 is a schematic diagram of an ignition interruption circuit included in the shift assistance means of the stern drive unit shown in FIG. 1 and incorporating various of the features of the invention.

Before explaining at least one of the embodiments of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF THE PREFERRED EMBODIMENT

The invention will be described for use in a stern drive unit; however, it can be adapted for use in outboard motors and other marine propulsion devices.

Shown in FIG. 1 is a marine propulsion stern drive unit 10 mounted on a boat 12 having a transom 14. The stern drive unit 10 includes an engine 16 (illustrated fragmentarily) suitably mounted on the boat hull forwardly of the transom 14 and a stern drive leg or propulsion leg 18 which is fixedly attached to the engine 16 and includes a lower or propulsion unit 20. The propulsion unit 20 is vertically tiltable, as well as horizontally swingable, relative to engine 16.

The engine 16 preferably comprises a conventional internal combustion engine having a suitable ignition system, shown diagrammatically as box 19 in FIG. 9. For example, the ignition system 19 could be a conventional battery and distributor type ignition system. As will be further described below, the ignition system 19 is selectively interrupted or rendered inoperative to prevent engine ignition when interface switch means or an SCR 204, included in an ignition interruption circuit 200 (see FIG. 9), is selectively rendered conductive to disable or short out the ignition system 19 by connecting it to ground.

While various propulsion leg constructions can be used, in a specific construction illustrated, the propulsion leg 18 is constructed generally in accordance with the Shimanckas U.S. Pat. No. 3,183,880, issued May 18, 1965, which patent is incorporated herein by reference. As used herein, the term "stern drive leg" and "propulsion leg" encompasses the intermediate unit A, the propulsion unit B, and the swivel support C disclosed in the above-identified Shimanckas patent, which assembly or units are designated generally in the present drawings by the reference numerals 22, 20 and 24, respectively.

The propulsion unit 20 includes an exhaust housing 25 and a lower gearcase 26. Rotatably mounted in the gearcase 26 is a propeller shaft 27 carrying a propeller 28. Rotatably mounted within the propulsion unit 20 is a drive shaft 30 extending transversely of the propeller shaft 27 and carrying a bevel drive gear 32 on the lower end. Rotatably mounted within the intermediate unit 22 is a power shaft 34 which is operably connected at one end to the engine crankshaft (not shown) and is drivingly connected at the other end to the drive shaft 30 via a gear-type universal fitting 36 (illustrated schematically and corresponding generally to fittings 73 and 78 in the above-identified Shimanckas patent). The drive shaft 30 is preferably connected to the propeller shaft 27 through a reversing transmission, generally designated 42.

While various arrangements can be used, in the specific construction illustrated, the reversing transmission 42 includes a pair of axially spaced bevel gears 44 and 46 which are mounted for rotation coaxially with and independently of the propeller shaft 27 and mesh with the drive gear 32. The transmission 42 also includes clutch dog means or a clutch dog 48 (see FIG. 2) which is carried or splined on the propeller shaft 27 intermediate the bevel gears 44 and 46 for common rotation with propeller shaft 27 and for axial movement relative to propeller shaft 27 between a central or neutral position out of engagement with the bevel gears 44 and 46, a forward drive position (to the left of the neutral position) in full driven rotary engagement with the bevel gear 44, and a reverse drive position (to the right of the neutral position) in full driven rotary engagement with the bevel gear 46.

More particularly, the clutch dog 48 includes one or more driving lugs 49 located on opposite end faces of the clutch dog 48. The driving lugs 49 are disposed to engage complimentary drive lugs 51 (see FIG. 2) on the bevel gears 44 and 46. Thus, when the clutch dog is moved completely into one of the forward or reverse drive positions, the lugs 49 at one end of the clutch dog are fully engaged with the corresponding complementary driving lugs 51 included in one of the bevel gears 44 and 46, and the propeller shaft 27 is driven in either a forward or reverse drive condition depending on which bevel gear 44 and 46 is engaged by the clutch dog 48.

The clutch dog 48 is moved between the neutral, forward drive, and reverse drive positions by a conventional lower shift mechanism generally designated 50 including a shift actuator 52 which is operably connected to the clutch dog 48 and is mounted for common axial movement therewith relative to the propeller shaft 27 while affording rotation of the propeller shaft 27 relative to both the clutch dog 48 and the shift actuator 52. The shift mechanism 50 also includes an actuating rod 54 which is supported within the propulsion unit 20 for reciprocal movement transversely of the propeller shaft axis between the illustrated neutral position and forward and reverse drive positions. The actuating member 54 is connected to the shift actuator 52 to effect axial movement of the shift actuator 52, and thus axial movement of the clutch dog 48, relative to the propeller shaft 27 in response to movement of the actuating rod 54 transversely of the propeller shaft axis. In the specific construction illustrated, downward movement of the actuating rod 54 causes the shift actuator 52 to be moved to the left while upward movement causes the shift actuator 52 to be moved to the right.

Various suitable arrangements can be used for connecting the actuating rod 54 to the shift actuator 52 and for connecting the shift actuator 52 to the clutch dog 48 to provided the shifting operation described above. The Hagen U.S. Pat. No. 3,919,964, issued Nov. 18, 1975, describes a particularly suitable arrangement, which patent is incorporated herein by reference.

Selective movement of the actuating rod 54 to shift the transmission 42 is effected by the operator, as will be more fully explained, through a lower shift unit generally designated 55 (see FIG. 5) mounted inside the propulsion unit 20 at the juncture between the exhaust housing 25 and the gearcase 26 and mechanically connected to and between the upper end of the actuating rod 54 and a shift converter unit generally designated 56, located inside the boat and preferably mounted on the engine 16 (specific mounting not shown). The shift converter unit 56 includes a housing 58, and at least a portion of shift assistance means, generally designated 60 (see FIG. 3) including shift lever means, generally designated 61, affixed on a pulley segment shaft 62 which is rotatably mounted on the housing 58 for affording rotational movement of the shift lever means 61 relative to and exteriorly of the housing 58. The shift lever means 61 is operably connected to a suitable operator positionable control including, for example, a push-pull cable 64 and a main control lever (not shown) and rotates in opposite directions from a neutral position in response to forward and backward force or movement of the push-pull cable 64 resulting from operation of the main control lever by an operator. The shift lever means 61 is shown in the neutral position and will be described in more detail, along with a further description of the shift assistance means 60, which includes the ignition interruption circuit 200 mentioned earlier, after a general description of a pull-pull cable assembly which completes the shift mechanisms or shift means required to effect shifting of the transmission 42 in response to operator movement of the push-pull cable 64.

More particularly, a pull-pull cable assembly generally designated 65 (see FIG. 4) is provided for connecting the shift lever means 61 to the actuating rod 54, via the lower shift unit 55, to vertically or axially displace the actuating member 54 (i.e. move the actuating member 54 transversely of the propeller shaft axis) in response to rotational movement of the shaft 62 by the shift lever means 61, and thereby displace the shift actuator 52 and the connected clutch dog 48 (i.e., move these components axially relative to the propeller shaft 27) to operate the transmission 42.

As schematically illustrated in FIG. 4, the cable assembly 65 comprises a flexible dual pull-pull type cable conduit assembly including first and second shift cables 66 and 68 slidably disposed inside a flexible outer conduit or sheath 70 and extending outwardly beyond the opposite ends of the sheath 70. The cable assembly 65 extends through the interior of the intermediate unit 22 and through the propulsion unit 20 with one end of the sheath 70 connected to the shift converter unit 56 and the other end connected to the lower shift unit 55.

As illustrated, the lower shift unit 55 and means, preferably in the form of a pulley segment 72 mounted or keyed for rotation with pulley segment shaft 62, and an idler pulley 73, are provided for connecting the opposite ends of each of the shift cables 66 and 68 to the shift lever means 61 and to the upper end of the actuating rod 54 so that movement of one shift cable causes movement of the other shift cable in the opposite direction and the "working" cable is in tension, i.e. is pulled to effect movement of the actuating rod 54 and clutch dog 48. Specifically, the first shift cable 66, in response to rotational movement of the shaft 62 and pulley segment 72 in one direction, is pulled in a first direction to effect movement of the actuating rod 54 and clutch dog 48 in one direction while the second shift cable 68 is moved in the opposite or second direction and the second shift cable 68, in response to rotational movement of the shaft 62 and pulley segment 72 in the opposite direction, also is pulled in the first direction to effect movement of the actuating rod 54 and clutch dog 48 in the opposite direction while the first shift cable 66 is moved in the second direction.

Any appreciable slack in the cables 66 and 68, caused for example by stretching during use or the accumulation of manufacturing tolerances at the time of assembly, can translate into lost motion in the shifting assembly. To minimize this potentiallty, cable tensioning means generally designated 74 (see FIG. 4) is preferably provided for preloading on the cable assembly sheath 70 in a direction opposite the pulling direction of the shift cables 66 and 68 so as to bow the sheath 70 and thereby maintain the shift cables substantially taut.

The transmission 42, the lower shift mechanism 50, the lower shift unit 55, the pull-pull cable arrangement 65, the cable tensioning means 74, and the specific arrangement of the various components thereof does not constitute part of the invention. Such components are described in more detail in the earlier referenced pending U.S. patent application Ser. No. 890,499, assigned to the same assignee as this application. Accordingly, the assemblies just noted above are illustrated schematically or have not been described in complete detail for purposes of simplification.

Heretofore, as illustrated in FIG. 1*a*, rotation of a pulley segment and hence, shifting of a reversing transmission, was effected by a one-piece shift arm connected between an operator control or a push-pull cable, and the shaft of the pulley segment. Movement of the push-pull cable resulted in rotational movement of the one-piece shift arm and the pulley segment.

With shifting mechanisms operated by a one-piece shift arm as shown in FIG. 1*a*, or with other shifting mechanisms heretofore utilized with other marine propulsion devices, difficulty in shifting is occasionally encountered when the axial movement of the clutch dog during transmission shifting results in a face-to-face or a corner drive condition with one of the transmission bevel gears. Referring to the transmission shown in FIG. 2, assuming a face-to-face condition (not specifically shown), the outer face of a clutch dog lug 49 abuts the outer face of a bevel gear lug 51, and the axial shift actuator force urging the clutch dog into engagement with the bevel gear as a result of an operator attempting to shift into a forward or reverse drive position causes the clutch dog 48 and a bevel gear to rotate together, with the clutch dog lugs and bevel gear lugs abutting or remaining in a face-to-face condition, thereby preventing full engagement of the cluth dog with the bevel gear, or preventing complete movement of the clutch dog into a forward or reverse drive position.

In a corner drive condition, the lugs 51 of one of the bevel gears occasionally drive the clutch dog lugs 49, but only the "corners" of the clutch dog lugs and the driving bevel gears lugs contact, and hence full engagement of the clutch dog and the driving bevel gear in a drive position is prevented. Specifically, the bevel gear lugs transmit torque to the clutch dog lugs as a result of the corner contact or corner drive condition so that the clutch dog and driving bevel gear sometimes rotate together in the same relative angular position, and hence, the corner drive condition is maintained. In addition, in the partially engaged or corner drive condition, the tangential forces on the clutch dog lugs due to the torque transmitted from the driving bevel gear which causes the clutch dog 48 to rotate, acts on the driving corners or edges of the clutch dog lugs to offset or resist the axial shift actuator shifting force trying to move the clutch dog into full engagement with the driving bevel gear. Generally, a face-to-face or corner drive condition, hereinafter sometimes collectively referred to as a "lock-out condition", will be maintained as long as there is sufficient engine torque transmitted from the driving bevel gear to the clutch dog to keep the clutch dog and the bevel gear rotating together or in the same relative angular position.

In order to ovecome the lock-out condition described above, and in order to generally assist in transmission shifting, the earlier mentioned shift assistance means generally designated 60 (see FIG. 3), is provided to include the shift lever means 61 which replaces the one-piece shift arm of FIG. 1*a*. In addition to the shift lever means 61 effecting movement of the pull-pull cable arrangement, the shift assistance means also is provided to include the earlier mentioned ignition interruption circuit 200 for selectively interrupting the ignition of the internal combustion engine to momentarily reduce the engine torque transmitted by a driving bevel gear to the clutch dog to effect relative angular displacement of the clutch dog and the driving bevel gear, thereby assisting or enabling axial movement of the clutch dog into a drive position in full engagement with a bevel gear. In addition to overcoming the above described lock-out condition, the shift assistance means also assists or enables axial movement of the clutch dog out of a drive position in engagement with a bevel gear, since the reduction in engine torque due to ignition interruption will reduce the "out of gear" forces exerting by the driving bevel gear lugs on the driving faces of the clutch dog lugs.

More particularly, while various arrangements are possible, the shift assistance means 60 preferably comprises load sensing means, generally designated 63, which includes the shift lever means 61 and switch means or a switch 130 (described below), which when actuated, renders the ignition interruption circuit 200 operative for selectively interrupting the ignition of the internal combustion engine, thereby assisting transmission shifting. The load sensing means 63 generally senses the resistance to the shift actuator force urging the clutch dog into a drive position in full engagement with a bevel gear, and also preferably senses resistance to urging the clutch dog out of a drive position.

More particularly, while various arrangements could be utilized, as illustrated in the preferred construction shown in FIG. 3, the shift lever means 61 generally comprises a mechanical lost motion arrangement made up of upper and lower members 80 and 92 biased to a normal relative position, and the switch 130 is located so that it is actuated when the upper and lower members are displaced from a normal relative position. Specifically, the upper and lower shift lever members 80 and 92 are biased by bias means 120 (described below) so that a predetermined resistance to axial movement of the clutch dog during transmission shifting causes the bias means to be overcome so that the lower member 92 is pivoted relative to the upper member 80, thereby actuating the switch 130.

While various arrangements could be utilized, the upper member 80 preferably includes a forked end 82 connected by a bolt 84 to the pulley segment shaft 62 for rotation therewith and includes an upper end 86 having a bearing 88 mounted in an aperture 90. The lower member 92 is pivotally connected to the upper member 80 by a pivot stud 94 extending from the lower member through the bearing 88, the stud 94 being connected to the upper member by an arrangement including washers 96 and a lock nut 98. The lower member 92 also includes a second pivot stud 102 spaced from the first pivot stud 94 and suitably connected to the operator controlled push-pull cable 64 as illustrated.

As best illustrated in FIGS. 6 and 7, the lower member 92 has an offset lower portion 108 which includes generally opposed and spaced retaining flanges 104 which cooperate with complimentary stop flanges 106 depending from the upper member 80 to retain the bias means or U-shaped spring 120 in a generally fixed position, as will be described more below. The lower portion 108 also includes an end portion having a raised cam 110 having an inner cam edge 112 formed with raised edges 114 and a central recess 116, as illustrated.

As noted, the shift lever means 61 also includes bias means, preferably in the form of the U-shaped spring 120, having outwardly extending arms 123 which rest against the complimentary retaining flanges 104 and stop flanges 106. The bias means or spring 120 is provided for retaining the upper and lower members 80 and 92 in a normal position relative to each other when a shifting force is applied to the pivot stud 102 of the lower member 92 by the push-pull cable 64, so that both members 80 and 92 rotate together with the pulley segment shaft 62. When shift resistance to axially moving the clutch dog into or out of a drive position exceeds an upper limit and is transmitted to the pulley segment shaft 62 to resist rotation of the upper member 80, the continued force exerted by the push-pull cable 64 on the lower member 92 causes the flanges 104 and 106 to displace one of the arms 123 of the U-shaped spring 120 relative to the other arm, resulting in the lower member 92 pivoting with pivot stud 94 relative to the upper member 80. Since the bias means or U-shaped spring is bidirectional, the lower member 92 will pivot relative to the upper member 80 in either direction, depending on whether the operator controlled cable 64 is pulling or pushing on pivot stud 92 when resistance to shifting exceeding the upper limit occurs.

More particularly, when a push or pull force is exerted on the lower member 92 by the operator controlled cable 64, the lower member 92 is rotated coincident with the upper member 80 (assuming that resistance to transmission does not occur) to effect rotation of the pulley segment shaft 62 and hence, the clutch dog 48 is moved into a drive position in full engagement with a bevel gear as described above. If, however, a lock-out condition does occur when the push-pull cable 64 exerts a force on the lower member 92 and the shift resistance exceeds an upper limit, the lower member 92 pivots relative to the upper member 80, and this relative displacement is sensed by or actuates the switch 130 which, in turn, renders operative the ignition interruption circuit 200 (see FIG. 8).

More particularly, while various arrangements could be utilized, the first switch means or switch 130 comprises a normally open switch 130 having an actuator 131, and which is suitably mounted on a lower offset portion 137 of the upper member 80 by screws 139 so that the actuator 131 rests in the recess 114 of the cam 110 of the lower member 92 when the upper and lower members 80 and 92 are in their normal relative position. Thus, when the lower member 92 pivots relative to the upper member 80 in either direction, the actuator 131 of the switch 130 is depressed by one of the raised edges 114 of the cam 110 as shown, for example, by the phantom lines in FIG. 3.

As schematically and best shown in FIG. 9, the switch 130 is normally open and depression of the actuator 131 closes the switch to render the ignition interruption circuit 200 operative. As noted, when the upper and lower members 80 and 92 are retained in or returned to a normal relative position by the bias means 120 (when shift resistance no longer exceeds the upper limit), the actuator 131 rests in the recession 114 so that the switch 130 is open and the interruption circuit 200 is deactuated.

The shift assistance means 60 also preferably includes position sensing means, generally designated 129, for generally sensing the axial position of the clutch dog 48, and the ignition interruption circuit is responsive to the position sensing means for selectively controlling the ignition of the internal combustion engine. More particularly, while various arrangements could be utilized, as illustrated in FIG. 3, the position sensing means preferably comprises second switch means or a second switch 132 having an actuator 133, and a cam 142 which extends from the side portion of the upper member 80. The switch 132 is suitably mounted to an adjustable bracket 135 which is connected to the shift converter housing 158 by bolts 136. The cam 142 includes a cam edge 143 with a central recess 145 and raised edge portions 144 which actuate the second switch means 132, for example, when the upper member 80 has rotated to a position corresponding to the clutch dog 48 having moved completely into one of the forward or reverse drive positions.

It is to be understood that the position sensing means 129 could be used independently of the load sensing means 163 and could be actuated at other points of travel of the clutch dog to selectively control the ignition interruption circuit and engine ignition. As illustrated in the preferred construction, however, the position sensing means 129 includes the normally closed switch 132 which senses or is actuated at extremes of movement of the upper member 80, and which is connected in series with the switch 130 so as to be actuated to override the first switch 130 to terminate the selective interruption of the engine ignition (see FIG. 9). This override condition could occur, for example, due to excessive stroke of the push-pull cable 64, or due to misadjustment of the neutral position of the shift lever means 61.

Before explaining the specific details of the preferred ignition interruption circuit 200, a general description of the major components and operation of the ignition interruption circuit 200 will be given.

Generally, the ignition interruption means or circuit 200 includes control means generally designated 217, operable for example, in response to actuation or closing of switch 130 for selectively interrupting the engine ignition in accordance with a timed cycle including an ignition-kill interval wherein the engine ignition is shorted out or interrupted, and an ignition-on interval wherein the engine ignition is enabled.

More particularly, the control means 217 preferably includes first timer means or a primary timer, generally designated 220, for providing a plurality of successive timed cycles. Specifically, the primary timer 220 is operative in cooperation with associated circuitry (described below) for controlling conduction of interface switch means generally designated 209, for example, including the earlier mentioned SCR designated 204, so that the SCR is turned on or rendered conductive to short out engine ignition for a period of time establishing the ignition-kill interval of a timed cycle, and so that the SCR is turned off for a period of time to restore or enable engine ignition, thereby estabishing the ignition-on interval of the timed cycle.

The control means 217 preferably includes second timer means or an overall timer, generally designated 230, which includes an output 276 which is coupled to a reset terminal 277 of the primary timer 220 and is operative in response to closing of switch 130 for establishing an overall cycle during which the primary timer 220 is rendered operative for providing the plurality of successive timed cycles. In the preferred construction illustrated, the primary timer 220 includes a lower terminal 255 connected to a charging capacitor 256 by a lead 257 so that the timer 220 is operative for successively increasing the duration of the successive ignition-kill intervals included in the successive timed cycles of an overall cycle. A filter capacitor 253 is also connected to terminal 255. This increasing duration feature is provided so that if a given ignition-kill interval does not have a sufficient duration to reduce engine torque so that transmission shifting is completed (the switch 130 thereby deactuating the primary and overall timers) the succeeding ignition-kill interval has a greater duration in order to provide a relatively greater or more prolonged reduction of engine torque to further assist transmission shifting.

In this regard, the occurrence of a corner drive condition, which as noted earlier causes the clutch dog and bevel gear to rotate together so that a tangential torque is produced which resists the axial shifting force, is dependent upon the relative sharpness of the clutch dog and bevel gear lug corners, the driving edges of which may be slightly chamfered. This is less of a tendency for the corner drive condition to occur when the lug corners are relatively sharp or new, and conversely there is more of a tendency for the corners to "hang up" or for a corner drive condition to exist when the corners are more chamfered or rounded, due to wear. Therefore, the feature of providing successive ignition-kill intervals of greater duration insures that the ignition interruption circuit 200 will automatically provide an ignition-kill interval having an increased duration sufficient to assist transmission shifting in response to the increased frequency or duration of a corner drive condition resulting from wear of the clutch dog and bevel gear lug corners. This feature of increasing duration of successive ignition-kill intervals also insures that engine ignition will be interrupted only for the increasing intervals of time necessary to assist complete transmission shifting, since when transmission shifting is completed, the primary and overall timers are deactuated by opening of switch 130. Thus, this feature provides an effective compromise between interrupting engine ignition to assist transmission shifting and maintaining maximum engine driveability during shifting.

The duration of the ignition-kill interval necessary to effect complete transmission shifting is generally greater at greater engine speed. In order to assist transmission shifting at idle or relatively greater engine speeds, for example at engine speeds ranging from 500 to 1200 rpm, the control 217 further includes speed sensing circuit means, generally designated 241, and preferably including a frequency to voltage converter 246. The converter 246 is operative in response to the engine speed increasing, for example from 500 to 1200 rpm or greater, for increasing the duration of the initial ignition-kill interval of an overall cycle from, for example, 50 milliseconds up to a maximum duration of 150 milliseconds. This increase in the initial ignition-kill interval is the result of the initial charge on the charging capacitor 256 being increased by the output voltage of the frequency to voltage converter appearing on an output 248, and which is coupled to the capacitor 256, which output voltage increases in response to increased engine speed. This feature effectively enhances the interruption circuit design compromise between interrupting of ignition to assist transmission shifting and maintaining engine drivability.

During transmission shifting, if the shift resistance increases above the upper limit and the switch 130 closes as discussed above, the overall and primary timers 220 and 230 of the ignition interruption circuit 200 are actuated. The overall timer 230 establishes the overall cycle or time limit during which the primary timer 220 is operative to provide successive timed cycles for assisting in transmission shifting. When transmission shifting has been completed, the switch 130 opens and deactuates the primary and overall timers. As will be explained further below, when the second or position sensing switch 132 opens, the first switch 130 is overrided and the ignition interruption circuit 200 is deactuated.

As noted earlier, any suitable type of ignition system can be utilized with the marine propulsion internal combustion engine 16. For purposes of example, it will be assumed that the engine 16 includes a standard battery ignition system 19 (shown diagrammatically as a box 19 in FIG. 9) conventionally including an ignition coil and a distributor having a set of points (not specifically shown) which normally operate to transmit voltage generated in the ignition coil to the engine spark plugs to effect ignition. The ignition system 19 is connected to the preferred ignition interruption circuit 200 at the point side of the ignition coil by a lead 202, the connection being schematically shown and indicated by a legend located within the box 19 representing the engine ignition system.

As noted earlier, in order to selectively interrupt the engine ignition, the circuit 200 includes interface switch means 209, preferably including the silicon controlled rectifier (SCR) 204, which as an anode-cathode path connected by a lead 202 to the point side of the ignition coil and to ground. When a gate signal is applied to the gate 206 of the SCR and a positive voltage is produced by the ignition coil, the SCR turns on shorting the positive voltage of the ignition coil to ground and preventing or interrupting engine ignition. As will be described further below, a gate signal is provided to the SCR 204 when a transistor 208 is turned on, the transistor also preferably included in the interface switch means 209. Specifically, the transistor 208 is turned on when base current flows out of the base 210 of transistor 208 in response to a NAND gate 212 having a low output, which low output occurs whenever inputs 214 and 216 of NAND gate 212 both receive a high input signal.

Before returning to a more specific description of the ignition interruption circuit 200, it is to be understood that if desired, a suitable engine ignition system could be interrupted by opening the ignition circuit of the ignition system, as well as by shorting the ignition circuit. Also the ignition circuit could be partially interrupted by cutting out predetermined cylinders of the engine. It is also to be understood that the purpose of the ignition interrupted means or circuit is to interrupt the engine ignition to assist transmission shifting, preferably long enough to reduce the engine torque to enable or assist effecting axial movement or shifting of the clutch dog into or out of full engagement with a transmission bevel gear, but the ignition interruption should not be long enough to shut off the engine. This purpose could be accomplished by various circuits or other control arrangements in various manners. For example, switch means, such as switch 130 could be utilized to turn on an SCR to provide the ignition interruption for as long as the switch 130 is activated. Also, switch means such as switch 130, and a single timer could be utilized to turn on an SCR to provide a single ignition interruption for a specified length of time. Other possible control arrangements for achieving ignition interruption will be discussed in connection with the description of the preferred ignition interruption circuit 200 given below.

Returning to a specific description of the preferred ignition interruption circuit 200 as schematically shown in FIG. 8, the overall and primary timers 230 and 220 could each comprise, for example, one half of a standard integrated circuit timer, Model No. LM556CN, manufactured by NATIONAL SEMICONDUCTOR. The various timer terminal connections illustrated or described herein correspond to connections to pins of the LM556CN timer. The specific pin connections are indicated by the pin numbers enclosed within circles located in the boxes which schematically represent the overall and primary timers 230 and 220.

When the primary timer 200 is actuated by the output of the overall timer 230, the timer 220 provides a high signal at its output 218 for a period of time corresponding to or establishing an ignition-kill interval. Specifically, the high output of timer 220 is coupled to the input 214 of NAND gate 212 (input 216 is already high) and causes the output of NAND gate 212 to go low, thereby allowing base current to flow and turning on transistor 208, and hence, rendering SCR 204 conductive so that the point side of the ignition coil is shorted out or grounded and the engine ignition is disabled or interrupted during an ignition-on interval.

The minimum duration of the ignition-kill interval is determined by selection of a resistor 222 and a capacitor 224 which are suitable connected to pins or terminals the timer 220 as shown. The timer 220 remains operative to provide a high output providing an ignition-kill interval for a duration of time which is determined by charging of capacitor 224, which charging results from current passing through resistor 222 and a diode 228. When the timer voltage threshold is reached, capacitor 224 discharges through resistor 222 and an additional resistor 226 (shunted by diode 228 during charging) to establish the duration of an ignition-on interval, the capacitor discharge causing the output 218 of the timer 220 to switch from high to low. This low output of timer 220 is coupled to the input 214 of NAND gate 212 and causes the output of NAND gate 212 to go high, thereby cutting off base current flow and turning off transistor 208, and hence, rendering SCR 204 nonconductive so that the point side of the ignition coil is not shorted out or grounded and the engine ignition is enabled during an ignition-on interval. When capacitor 224 is sufficiently discharged, the timer output switches back from low to high, repeating the above described operation and thereby providing a plurality of successive timed cycles each including an ignition-kill interval and an ignition-on interval.

As noted earlier, the duration of the successive ignition-kill intervals included in successive timed cycles increases by virtue of the increasing charge on charging capacitor 256 connected to timer terminal 255. More particularly, at an engine speed of 500 rpm, the initial ignition-kill interval of the overall cycle is, for example, 50 milliseconds, the second ignition-kill interval or pulse increases up to 65 milliseconds, the third ignition-kill pulse may increase up to 85 milliseconds, etc. up to a maximum duration of approximately 150 milliseconds if, for example, six pulses occur before the end of the overall cycle or before shifting of the transmission is completed. During the overall cycle, the duration of the ignition-on intervals increase to a lesser extent, for example, from 100 milliseconds to 150 milliseconds. The increasing charge on capacitor 256, and hence the increasing duration of successive ignition-kill and ignition-on intervals, is a result of charging current flowing from terminal 255 of the primary timer 220 to the charging capacitor 256. A maximum ignition-kill interval, for example, 150 milliseconds, is generally determined or established by the flat portion of the charge rate curve of the capacitor 256, and by the gain of the frequency to voltage converter 246 of the speed sensing means 241 discussed below. Although it could be arranged so that the primary timer 220 provides a fixed number of timed cycles, as shown in the preferred construction, the number of timed cycles is governed by the duration of the overall cycle of the overall timer 230, which duration could be, for example, 1.5 seconds.

More particularly, the frequency to voltage converter 246 is coupled to the positive voltage appearing at the point side of the ignition coil by lead 202 and by a lead 232 including a diode 234. Resistors 236 and 238 act as voltage dividers, capacitor 240 acts as filter and resistor 242 acts as a current limiter. With each positive voltage pulse which fires an engine cylinder (the SCR 204 must be off in order for a pulse to be developed to fire a cylinder) a transistor 244 having a base 243 coupled to the current limiting resistor 242 is rendered conductive. The frequency to voltage converter 246 could comprise for example, a NATIONAL SEMICONDUCTOR Model LM2907N-8, with pin connections as shown. The converter 246 has an input 245 which is AC coupled to the collector of transistor 244 by capacitor 247 and consequently provides a voltage at its output 248 having a magnitude proportional to the speed of the engine 16. Capacitor 252 and resistor 254 are selected to adjust the gain of the converter 246 and capacitor 250 provides a filter to limit the ripple on the output of the frequency to voltage converter 246.

When the primary timer 220 is first actuated during an overall cycle, the magnitude of the voltage on the capacitor 256 is initially established by the voltage output of the frequency to voltage converter 246, which voltage output is a function of or proportional to engine speed. As illustrated, diodes 258, 260 and 262 act as isolators, and resistor 264 provides a discharge path for capacitor 256 at the end of an overall cycle or when the primary timer 220 is otherwise deactuated. Again, due to the charge rate curve of capacitor 256 and the gain of the converter, the maximum duration of an initial or succeeding ignition-kill interval at engine speed of 1200 rpm or greater, is selected, for example, to be 150 milliseconds.

Assuming the initial ignition-kill interval is less than the maximum duration, the successive ignition-kill intervals continue to increase in duration until the primary timer 220 is deactuated. To insure this operation, diode 262 is backed biased by the high output 276 of the overall timer 230 so that the reduction in engine speed (resulting from ignition interruption), resulting in a reduction of the magnitude of the voltage at the converter output 248, does not result in capacitor 256 discharging through the converter during the overall cycle. When the overall cycle is completed, the output of the overall timer 230 goes low and diode 262 is forward biased, diodes 260 and 258 are back biased, and the charging capacitor 256 discharges through resistor 264.

As noted earlier, the operation of the primary timer 220 is subject to actuation of the overall timer 230 which is actuated by closing of the first switch 130. More particularly, the overall timer 230 has a reset input 231 connected to the output 273 of a NAND gate 274 which has both inputs 275 connected to the series combination of the normally opened first switch 130 and the normally closed second switch 132. The inputs 275 of the NAND gate 274 are connected to switches 130 and 132 through a lead 271 including a resistor 270. A resistor 277 is connected to a conventional power supply, generally designated 284, and to resistor 271 for coupling the inputs 275 of the NAND gate 274 to a high signal unless switch 130 is actuated (and switch 132 remains deactuated) so that the inputs 275 of the NAND gate 274 are connected to ground. Thus, the state of the inputs 275 changes from high to low (due to the connection to ground) when the switch 130 closes, and the output of NAND gate 274 coupled to the reset input 231 of the overall timer 230 goes high thereby actuating the timer 230. The high output appearing on the output 273 of the NAND gate 274 is also coupled by a lead 279 to the input 216 of NAND gate 212 so that it is conditioned to charge its output state from high to low when the output state of timer 230 changes from low to high, and vice versa. The NAND gates 274 and 212 are preferably CMOS components with high immunity to noise which is desirable in a noisy engine environment. For example, the NAND gates could each comprise ½ of an integrated circuit Model Number 40107BE.

As noted, when the overall timer 230 is enabled, it provides a high output on output 276 which is coupled to the reset input 277 of the first timer 220, thereby actuating the first timer 220. Inherent delays in this switching of the overall and primary timers, in addition to the noise immunity of the NAND gates, also provide enhanced immunity to noise and other interference to prevent false switching of the SCR 204, and hence to prevent false ignition interruption.

The duration of the overall cycle established by the overall timer 230 is determined by selection of resistor 278 and capacitor 280 connected to the timer 230 as shown. Capacitor 282 operates as a filter. The duration of the overall timer is selected to provide a generally sufficient number of timed cycles, for example six, during which the transmission shifting should be completed. The overall cycle can be terminated by opening of the switch 130, and can be reactivated by reclosure of the switch 130, corresponding to an operator moving the shift lever means 61 into neutral (termination), and then back again to a shift position (reactivation, assuming shift resistance still exceeds the upper limit.)

The effect of actuation of the first switch 130 can be overrided or terminated by the normally closed second switch 132 when it is actuated or opened to break the connection to ground so that the inputs 175 go high switching the output of NAND gate 274 to low. Switch 132 opens in response, for example, to the upper member 80 of the shift lever means 61 being displaced to a position generally corresponding to the clutch dog having completed movement to the drive position, e.g., in response to completion of transmission shifting, as discussed earlier. It is to be understood that the various components of the ignition interruption circuit could be included, for example, on a circuit board, which circuit board could be mounted in any convenient position (not specifically shown) in generally proximity to the switches 130 and 132 if desired. The specific wire connections of the switches 130 and 132 to the ignition interruption circuit 200 are not shown in FIG. 3 for purposes of simplicity.

As should be appreciated from the foregoing description, the invention herein also provides a method for assisting transmission shifting in a marine propulsion device including an internal combustion engine and a transmission having a bevel gear and a clutch dog movable between a neutral position out of engagement with the bevel gear and a drive position in full engagement with the bevel gear, the method broadly comprising the steps of sensing shifting of the transmission (e.g., by load or position sensing means) and selectively interrupting engine ignition during the transmission shifting prior to the clutch dog moving to the drive position.

Also, although the invention was described in connection with a marine propulsion device having a specific arrangement of shift mechanisms, other suitable shift mechanisms or shift means arrangements could be utilized, and the invention encompasses apparatus for assisting transmission shifting in any marine propulsion device including an internal combustion engine and a transmission having a bevel gear and a clutch dog movable between a neutral position out of engagement with the bevel gear and a drive position in full engagement with the bevel gear, the apparatus broadly comprising means for sensing shifting of the transmission (e.g., load or position sensing means) and means for selectively interrupting engine ignition during the transmission shifting prior to the clutch dog moving to the drive position.

Also, it is to be understood that the invention is not confined to the particular construction and arrangement of parts herein illustrated and described, but embraces all such modified forms thereof, as come within the scope of the following claims.

What is claimed is:

1. A marine propulsion device including an internal combustion engine, a propulsion unit, a propeller shaft rotatably mounted in said propulsion unit and carrying a propeller, a drive shaft rotatably mounted in said propulsion unit and adapted to be driven by said internal combustion engine, said drive shaft including a drive gear, a transmission including a bevel gear rotatably mounted on said propeller shaft and in meshing engagement with said drive gear, and including clutch dog means mounted to said propeller shaft for reciprocal axial movement between a neutral position wherein said clutch dog means is out of engagement with said bevel gear, and a drive position wherein said clutch dog means is in full engagement with said bevel gear to effect coincident rotation of said bevel gear and said propeller shaft, and shift means for axially moving said clutch dog means between said neutral and drive positions, said shift means including shift assistance means including a first member movable in response to clutch dog movement, a second member movable in response to actuation by an operator and connected to said first member for movement in common therewith and for movement relative to said first member, and means for interrupting engine ignition in response to relative movement between said first and second members.

2. A device in accordance with claim 1 and further including bias means for retaining said first and second members in a normal position relative to each other when said second member moves in response to a force applied by an operator control and shift resistance is less than an upper limit, and for allowing relative displacement of said first and second members from said normal position when said shift resistance exceeds said upper limit, and wherein said ignition interruption means selectively interrupts ignition of said internal combustion engine in response to relative displacement of said first and second members from said normal position.

3. A device in accordance with claim 2 wherein said ignition interruption means includes first switch means operable to selectively interrupt the ignition of said internal combustion engine, and wherein one of said first and second members includes first cam means for actuating said first switch means in response to relative displacement of said first and second members from said normal position.

4. A device in accordance with claim 3 wherein said ignition interruption means further includes second switch means operable when actuated for overriding said first switch means and terminating said selective interruption of said ignition, and wherein said first member includes second cam means for actuating said second switch means when said first member is displaced to a position generally corresponding to said clutch dog means having completed movement to said drive position.

5. A device in accordance with claim 2 and further including first pivot means for supporting said first member for pivotal movement effecting axial movement of said clutch dog means between said neutral and drive positions, and second pivot means spaced from said first pivot means for pivotally connecting said second member to said first member, and wherein said bias means is operative for connecting said first and second members so that said first and second members pivot together in said normal position about said first pivot means when a force is applied to said second member by the operator control and said shift resistance is less than said upper limit, and so that said second member pivots about said second pivot means relative to said first member when said resistance exceeds said upper limit.

6. A device in accordance with claim 5 wherein said ignition interruption means includes first switch means connected to said first member and operable when actuated for rendering said ignition interruption means operable to selectively interrupt the ignition of said internal combustion engine, and wherein said second member includes first cam means for actuating said first switch means in response to said second member pivoting about said second pivot means relative to said first member.

7. A device in accordance with claim 5 wherein said bias means comprises a generally U-shaped spring having a pair of outwardly extending arms, and wherein said first and second members includes complimentary flange means for retaining said U-shaped spring in a generally fixed position relative to said first and second members when said shift resistance is less than said upper limit, and for displacing one of said spring arms relative to the other spring arm when said shift resistance exceeds said upper limit and said second member pivots about said second pivot means relative to said first member.

8. A device in accordance with claim 7 wherein said ignition interruption means includes first switch means connected to said first member and operable when actuated for rendering said ignition interruption means operable to selectively interrupt the ignition of said internal combustion engine, wherein said second member includes first cam means for actuating said first switch means in response to said second member pivoting about said second pivot means relative to said first member, wherein said ignition interruption means further includes second switch means operable when actuated for overriding said first switch means and terminating said selective interruption of said ignition, and wherein said first member includes second cam means for actuating said second switch means when said first member pivots about said first pivot means to a position generally corresponding to said clutch dog means having completed movement to said drive position.

9. A device in accordance with claim 1 wherein said ignition interruption means includes control means operable for interrupting the engine ignition in accordance with a timed cycle including an ignition-kill interval wherein the engine ignition is interrupted, and an ignition-on interval wherein the engine ignition is enabled.

10. A device in accordance with claim 9 wherein said control means includes first timer means for providing a plurality of said timed cycles in succession.

11. A device in accordance with claim 10 wherein said first timer means is operative for successively increasing the duration of said ignition-kill intervals included in said successive timed cycles.

12. A device in accordance with claim 10 wherein said control means includes second timer means coupled to said first timer means for establishing an overall cycle during which said first timer means is rendered operative for providing said successive timed cycles.

13. A device in accordance with claim 10 wherein said first timing means is operative for providing successive timed cycles wherein the initial ignition-kill interval has a predetermined minimum duration, and wherein said control means further comprises speed sensing means coupled to said first timer means and operative in response to engine speed increasing above a predetermined lower speed for increasing the duration of said initial ignition-kill interval above said predetermined minimum duration.

14. A device in accordance with claim 13 wherein said speed sensing means is operative for increasing the duration of the said initial ignition-kill interval up to a predetermined maximum duration.

15. A device in accordance with claim 13 wherein said first timer means is operative for successively increasing the duration of said ignition-kill intervals included in said successive timed cycles, and wherein said control means includes second timer means coupled to said first timer means for establishing an overall cycle during which said first timer means is rendered operative for providing said successive timed cycles.

16. A device in accordance with claim 10 wherein said first timer means is operative for successively increasing the duration of said ignition-kill intervals included in said successive timed cycles, said ignition-kill intervals having a predetermined minimum duration, and wherein said control means includes second timer means coupled to said first timer means for establishing an overall cycle during which said first timer means is rendered operative for providing said successive timed cycles, said control means also including speed sensing means coupled to said first timer means and operative in response to engine speed increasing above a predetermined lower speed for increasing the duration of the initial ignition-kill interval in said overall cycle above said predetermined minimum duration.

17. A device in accordance with claim 1 wherein said ignition interruption means includes control means, responsive to relative movement between said first and second members when the force resisting movement of said clutch dog means to the drive position exceeds an upper limit, for selectively interrupting the engine ignition in accordance with a timed cycle including an ignition-kill interval wherein the engine ignition is interrupted, and an ignition-on interval wherein the engine ignition is enabled.

18. A device in accordance with claim 17 and further including bias means for retaining said first and second members in a normal position relative to each other when said second member moves in response to a force applied by an operator control and shift resistance is less than an upper limit, and for allowing relative displacement of said first and second members from said normal position when said shift resistance exceeds said upper limit, and wherein said control means includes first timer means for providing a plurality of said timed cycles in succession in response to relative displacement of said first and second members from said normal position.

19. A device in accordance with claim 18 wherein said ignition interruption means includes first switch means operable when acutated for rendering said first timer means operable for providing said successive timed cycles, and wherein one of said first and second members includes first cam means for actuating said first switch means in response to relative displacement of said first and second members from said normal position.

20. A device in accordance with claim 19 wherein said ignition interruption means further includes second switch means operable when actuated for overriding said first switch means and deactuating said first timer means, and wherein said first member includes second cam means for actuating said second switch means when said first member is displaced to a position generally corresponding to said clutch dog means having completed movement to said drive position.

21. A marine propulsion device including an internal combustion engine, a propulsion unit, a propeller shaft rotatably mounted in said propulsion unit and carrying a propeller, a drive shaft rotatably mounted in said propulsion unit and adapted to be driven by said internal combustion engine, said drive shaft including a drive gear, a reversing transmission including a pair of bevel gears rotatably mounted on said propeller shaft and in meshing engagement with said drive gear, and including clutch dog means mounted to said propeller shaft for reciprocal axial movement between a neutral position wherein said clutch dog means is out of engagement with said bevel gears, and forward and reverse drive positions wherein said clutch dog means is in full engagement with one of said bevel gears to effect coincident rotation of said one bevel gear and said propeller shaft, and shift means for axially moving said clutch dog means between said neutral and one of said drive positions, said shift means including shift assistance means including ignition interruption means for selectively interrupting the ignition of said internal combustion engine to reduce the engine torque transmitted to said bevel gears to effect relative angular displacement of said clutch dog means and said bevel gears to thereby assist said shift means in moving said clutch dog means to said drive position, said ignition interruption means including control means including primary timer means operable for interrupting the engine ignition in accordance with a plurality of successive timed cycles, each including an ignition-kill interval wherein the engine ignition is interrupted, and an ignition-on interval wherein the engine ignition is enabled, and also including overall timer means coupled to said first timer means for establishing an overall cycle during which said first timer means is rendered operative for providing said successive timed cycles.

22. A device in accordance with claim 21 wherein said shift assistance means includes load sensing means for generally sensing the shift resistance to effecting axial movement of said clutch dog means into and out of one of said drive positions, and wherein said ignition interruption means is responsive to said load sensing means for selectively interrupting the ignition of said internal combustion engine when said shift resistance exceeds an upper limit.

23. A device in accordance with claim 21 wherein said control means includes interface switch means operable, when actuated, for selectively interrupting engine ignition, and NAND gate means interconnected to said primary and overall timers and to said interface switch means for making said ignition interruption circuit generally insensitive to noise so as to prevent false interruption of engine ignition.

24. A device in accordance with claim 23 wherein said primary and overall timer means each include a reset terminal and an output terminal, said output terminal of said overall timer means being connected to said reset terminal of said primary timer means, and wherein said NAND gate means includes a first NAND gate having an input, and also having an output connected to said reset terminal of said overall timer means, and a second NAND gate having a first input connected to said first NAND gate output and a second input connected to said primary timer means output, and having an output connected to said interface switch means.

25. A device in accordance with claim 24 wherein said shift assistance means includes first switch means connected to said input of said first NAND gate and operative when actuated for changing the output state of said first NAND gate, thereby actuating said overall and primary timers and selective interruption of said engine ignition.

26. A device in accordance with claim 25 wherein said first switch means comprises normally open first switch means and wherein said shift assistance means further includes normally closed second switch means connected in series with said first switch means and operable when actuated to override said first switch means so that the output state of said first NAND gate prevents operation of said overall and primary timer means and selective interruption of said engine ignition.

27. A device in accordance with claim 26 wherein said interface switch means comprises a transistor having a base connected to the output of said second NAND gate and having an emitter-collector path, and also comprises an SCR having a gate connected to said emitter-collector path and having an anode-cathode path which is rendered conductive when the output of said second NAND gate renders said transistor conductive to selectively interrupt engine ignition.

28. A marine propulsion device including an internal combustion engine, a propulsion unit, a propeller shaft rotatably mounted in said propulsion unit and carrying a propeller, a drive shaft rotatably mounted in said propulsion unit and adapted to be driven by said internal combustion engine, said drive shaft including a drive gear, a transmission including a bevel gear rotatably mounted on said propeller shaft and in meshing engagement with said drive gear, and including clutch dog means mounted to said propeller shaft for reciprocal axial movement between a neutral position wherein said clutch dog means is out of engagement with said bevel gear, and a drive position wherein said clutch dog means is in full engagement with said bevel gear to effect coincident rotation of said bevel gear and said propeller shaft, and shift means for axially moving said clutch dog means between said neutral and drive positions, said shift means including shift assistance means including a first member movable in response to clutch dog movement, a second member movable in response to actuation by an operator and connected to said first member for movement in common therewith and for movement relative to said first member, and engine ignition interruption means including means operative in response to relative movement between said first and second members for interrupting engine ignition, and means operative in response to movement of said first member corresponding to movement of said clutch dog means into full engagement with said gear for discontinuing engine ignition interruption notwithstanding the position of said first and second members relative to each other.

29. Apparatus in accordance with claim 28 and further including means yieldably biasing said first and second members for movement in common with each other.

30. Apparatus in accordance with claim 28 and further including means for preventing relative movement between said first and second members in the absence of a force which resists full engagement of said clutch dog means with said gear and which exceeds, by more than a pre-selected amount, a force applied by the operator.

31. A device on accordance with claim 28 wherein said ignition interruption means includes control means operable for interrupting the engine ignition in accordance with a timed cycle including an ignition-kill interval wherein the engine ignition is interrupted, and an ignition-on interval wherein the engine ignition is enabled.

32. Apparatus for assisting transmission shifting in a marine propulsion device including an internal combustion engine and a transmission having a bevel gear and a clutch dog movable between a neutral position out of engagement with the bevel gear and a drive position in full engagement with the bevel gear, said apparatus comprising a first member movable in response to clutch dog movement, a second member movable in response to actuation by an operator and connected to said first member for movement in common therewith and for movement relative to said first member, and means for interrupting engine ignition in response to relative movement between said first and second members.

33. Apparatus in accordance with claim 32 and further including means yieldably biasing said first and second members for movement in common with each other.

34. Apparatus in accordance with claim 32 and further including means for preventing relative movement between said first and second members in the absence of a force which resists full engagement of the clutch dog with the bevel gear and which exceeds, by more than a pre-selected amount, a force applied by the operator.

35. A device in accordance with claim 32 wherein said ignition interruption means includes control means operable for interrupting the engine ignition in accordance with a timed cycle including an ignition-kill interval wherein the engine ignition is interrupted, and an ignition-on interval wherein the engine ignition is enabled.

36. Apparatus for assisting transmission shifting in a marine propulsion device including an internal combustion engine and a transmission having a bevel gear and a clutch dog movable between a neutral position out of engagement with the bevel gear and a drive position in full engagement with the bevel gear, said apparatus comprising a first member movable in response to clutch dog movement, a second member movable in response to actuation by an operator and connected to said first member for movement in common therewith and for movement relative to said first member, and engine ignition interrupting means including means operative in response to relative movement between said first and second members for interrupting engine ignition, and means operative in response to movement of said first member corresponding to movement of said clutch dog into full engagement with said gear for discontinuing engine ignition interruption notwithstanding the position of said first and second members relative to each other.

37. Apparatus in accordance with claim 36 and further including means yieldably biasing said first and second members for movement in common with each other.

38. Apparatus in accordance with claim 36 and further including means for preventing relative movement between said first and second members in the absence of a forch which resists full engagement of the clutch dog with the bevel gear and which exceeds, by more that a pre-selected amount, a force applied by the operator.

39. A device in accordance with claim 36 wherein said ignition interruption means includes control means operable for interrupting the engine ignition in accordance with a timed cycle including an ignition-kill interval wherein the engine ignition is interrupted, and an ignition-on interval wherein the engine ignition is enabled.

40. A method for assisting transmission shifting in a marine propulsion device including an internal combustion engine, a transmission having a bevel gear and a clutch dog movable between a neutral position out of engagement with the bevel gear and a drive position in full engagement with the bevel gear, a first member movable in response to clutch dog movement, and a second member movable in response to actuation by an operator and connected to the first member for movement in common therewith and for movement relative to the first member, said method comprising the steps of interrupting engine ignition in response to relative movement between the first and second members.

41. A method for assisting transmission shifting in a marine propulsion device including an internal combustion engine, a transmission having a bevel gear and a clutch dog movable between a neutral position out of engagement with the bevel gear and a drive position in full engagement with the bevel gear, a first member movable in response to clutch dog movement, and a second member movable in response to actuation by an operator and connected to the first member for movement in common therewith and for movement relative to the first member, said method comprising the steps of interrupting engine ignition in response to relative movement between the first and second members, and discontinuing engine ignition interruption notwithstanding the position of the first and second members relative to each other in response to full engagement of the dog with the gear.

* * * * *